US007042171B1

(12) United States Patent
Lin

(10) Patent No.: US 7,042,171 B1
(45) Date of Patent: May 9, 2006

(54) MULTIPLE-CCFL PARALLEL DRIVING CIRCUIT AND THE ASSOCIATED CURRENT BALANCING CONTROL METHOD FOR LIQUID CRYSTAL DISPLAY

(75) Inventor: Chang-Hua Lin, Taipei Hsien (TW)

(73) Assignees: Hsiu-Ying Li, Taipei Hsien (TW); Kai-Jun Pai, Taipei Hsien (TW)

( * ) Notice: Subject to any disclaimer, the term of this patent is extended or adjusted under 35 U.S.C. 154(b) by 0 days.

(21) Appl. No.: 10/996,377

(22) Filed: Nov. 26, 2004

(51) Int. Cl.
*G05F 1/00* (2006.01)

(52) U.S. Cl. ..... 315/291; 315/209 R; 315/244; 315/282; 315/209 PZ; 315/DIG. 2; 315/DIG. 5

(58) Field of Classification Search ..... 315/291, 315/282, 276, 278, 209 R, 244, 209 PZ, 315/DIG. 2, DIG. 4, DIG. 5, DIG. 7; 336/145, 336/147
See application file for complete search history.

(56) References Cited

U.S. PATENT DOCUMENTS 6,150,772 A * 11/2000 Crane ..... 315/291
6,459,216 B1 10/2002 Tsai
6,717,372 B1 * 4/2004 Lin et al. ..... 315/282
6,853,153 B1 * 2/2005 Gray ..... 315/291
6,936,975 B1 * 8/2005 Lin et al. ..... 315/224
2004/0066151 A1 * 4/2004 Kang et al. ..... 315/276

FOREIGN PATENT DOCUMENTS

| | | |
|---|---|---|
| TW | 478292 | 3/2002 |
| TW | 485701 | 5/2002 |
| TW | 556860 | 10/2003 |

* cited by examiner

*Primary Examiner*—Haissa Philogene
(74) *Attorney, Agent, or Firm*—Rosenberg, Klein & Lee

(57) ABSTRACT

A multiple-CCFL parallel driving circuit and the associated current balancing control method for LCD are presented, wherein the circuit comprises a plurality of CCFLs for providing the backlight for a LCD; a boosting transformer with a plurality of outputs for providing the driving voltage and current for driving the plurality CCFLs; a plurality of ballast capacitors, the ballast capacitors connect between the boosting transformer and the CCFLs; and a multiple CCFL current balancing circuit. This invention uses a low cost current mirror circuit to equalize the driving current of a plurality of CCFLs and thus significantly improve the uniformity of the displayed image on a large-size LCD.

17 Claims, 14 Drawing Sheets

| target driving current of CCFL | measured driving current of CCFL without multiple-CCFL current balancing circuit | measured driving current of CCFL with multiple-CCFL current balancing circuit |
|---|---|---|
| CCFL1 = 6 $mA_{rms}$ | CCFL1 = 6.025 $mA_{rms}$ | CCFL1 = 6.050 $mA_{rms}$ |
| CCFL2 = 6 $mA_{rms}$ | CCFL2 = 6.183 $mA_{rms}$ | CCFL2 = 6.036 $mA_{rms}$ |
| CCFL3 = 6 $mA_{rms}$ | CCFL3 = 6.452 $mA_{rms}$ | CCFL3 = 6.031 $mA_{rms}$ |
| CCFL4 = 6 $mA_{rms}$ | CCFL4 = 6.160 $mA_{rms}$ | CCFL4 = 6.022 $mA_{rms}$ |
| CCFL1 = 4 $mA_{rms}$ | CCFL1 = 4.026 $mA_{rms}$ | CCFL1 = 4.008 $mA_{rms}$ |
| CCFL2 = 4 $mA_{rms}$ | CCFL2 = 4.091 $mA_{rms}$ | CCFL2 = 4.032 $mA_{rms}$ |
| CCFL3 = 4 $mA_{rms}$ | CCFL3 = 4.942 $mA_{rms}$ | CCFL3 = 4.012 $mA_{rms}$ |
| CCFL4 = 4 $mA_{rms}$ | CCFL4 = 4.351$mA_{rms}$ | CCFL4 = 4.028 $mA_{rms}$ |
| CCFL1 = 2 $mA_{rms}$ | CCFL1 = 2.087 $mA_{rms}$ | CCFL1 = 2.060 $mA_{rms}$ |
| CCFL2 = 2 $mA_{rms}$ | CCFL2 = 2.375 $mA_{rms}$ | CCFL2 = 2.009 $mA_{rms}$ |
| CCFL3 = 2 $mA_{rms}$ | CCFL3 = 2.942 $mA_{rms}$ | CCFL3 = 2.003 $mA_{rms}$ |
| CCFL4 = 2 $mA_{rms}$ | CCFL4 = 2.433 $mA_{rms}$ | CCFL4 = 2.027 $mA_{rms}$ |

FIG. 14

MULTIPLE-CCFL PARALLEL DRIVING CIRCUIT AND THE ASSOCIATED CURRENT BALANCING CONTROL METHOD FOR LIQUID CRYSTAL DISPLAY

BACKGROUND OF THE INVENTION

1. Field of the Invention

The present invention relates to technology for a driving circuit and a method for cold cathode fluorescent lamp (CCFL) in the backlight modules of liquid crystal displays (LCDs). In particular, this invention provides a multiple-CCFL parallel driving circuit and the associated current balancing control method for LCD.

2. Description of the Related Art

With the arriving of digital era as well as networks of information and entertainment available to millions worldwide, requesting for thin and flat panel display panels is undoubtedly an ongoing trend. In addition, features, such as larger size, better performance, and excellent uniformity of brightness, for display screens are increasingly demanded in consumer market. A LCD combined with CCFL, which works as backlight source, is so far the best choice in terms of the market requirements mentioned above. Besides, as a key component for driving light source of a flat panel display, the backlight module, directly affecting the display quality of the panel, is the basis for the reliability and stability of a CCFL's brightness.

However, as the size of LCDs becomes larger and larger, a single CCFL in the backlight module becomes less and less able to provide enough backlight. As the quantity of CCFLs in backlight module increases, many researchers are focusing on how to maintain the driving current within a reasonable tolerance range, 6 $mA_{rms}$±5% (or ±0.3 $mA_{rms}$).

R.O.C. patent No. 478292 titled "Multiple-CCFL Driving System" provides a multiple-CCFL system. The system achieves current balancing within a plurality of CCFLs by using a balance controller with the principle of impedance matching. Please refer to FIG. 1, which shows the balance control circuit of this invention using storage energy components to achieve impedance match. However, the impedance of the storage energy components cannot be precisely controlled and the temperature of the storage energy components increases after it has been operating for a long period of time, thereby affecting the performance of current balance. The effect of natural emitting heat is not good because the backlight module is enclosed in the inner space of the LCD. After a long period of operation, it cannot keep the multiple CCFLs on current balance status. Therefore, the uniformity of the image of the LCD will be reduced substantially.

R.O.C. patent No. 556860 titled "A Current Equalizer for Backlight Module" provides a current equalizer for multiple CCFLs of a backlight module. This current equalizer comprises a plurality of differential current chokes 21, 22 and 23 and capacitors 24, 25 and 26. Please refer to FIG. 2. The current of the secondary side of the differential current chokes 21, 22 and 23 reacts with the current of the primary side of the differential current chokes 21, 22 and 23 by magnetic components. By this method, this invention achieves the goal of equalizing the driving current of multiple CCFLs. Because this circuit is comprised of magnetic components and impedance components, the performance of the current balance is also affected by temperature. When this invention is applied to a large-size LCD with a larger number of multiple-CCFL, the size of the current equalizer becomes larger. This is a disadvantage when designing a light and thin LCD of a large size.

R.O.C. patent No. 485701 titled "A Cold Cathode Fluorescent Lamp (CCFL) Driving Circuit" provides a driving circuit for CCFLs. This circuit utilizes a plurality of outputs on the secondary side of the transformer to drive the multiple-CCFL and tunes the driving current of the multiple-CCFL by a feedback method. Because the impedances of the CCFLs are different from each other in the steady state, this circuit does not balance the driving current for a plurality of CCFLs.

U.S. Pat. No. 6,459,216 titled "Multiple-CCFL Current Balancing Scheme for Single Controller Topologies" provides a circuit for improving current unbalance of multiple CCFLs. This circuit samples the voltage and current of the CCFLs, gets an average value by rectifier and filter, feedbacks the sample data to a controller and adjusts the current for a plurality of CCFLs. However, the CCFLs operate under high voltage and as such this circuit needs to be concerned about anti-high voltage to prevent the component being damaged. However, it increases the costs and the size of the circuit.

SUMMARY OF THE INVENTION

The main purpose of the present invention is to provide a multiple-CCFL parallel driving circuit and the associated current balancing control method for LCD. In the present invention, a current mirror technique is applied to CCFLs for equalizing the driving current of CCFLs, so as to achieve the current balance among CCFLs, and in turn improve the uniformity of the image of a large-size LCD.

In order to achieve the above goal, the present invention provides a multiple-CCFL parallel driving circuit and the associated current balancing control method for LCD. This invention employs a half-bridge resonant inverter to drive four sets of CCFLs and the current mirror circuit balances the driving current of CCFLs. This circuit comprises a dc power supply, a first dividing voltage capacitor, a second dividing voltage capacitor, a first switch, a second switch, a resonant inductor, a resonant capacitor, one set of one-to-four boosting transformer, a first ballast capacitor, a second ballast capacitor, a third ballast capacitor, a fourth ballast capacitor, a first CCFL, a second CCFL, a third CCFL and a fourth CCFL. Wherein, the first CCFL, the second CCFL, the third CCFL and the fourth CCFL separately connect to a multiple-CCFL current balancing circuit comprised of a bipolar junction transistor (BJT). By this way, it can achieve the goal of current balancing for multiple-CCFL.

The current mirror circuit of the current balancing circuit could be comprised of bipolar junction transistors, junction field-effect transistors (JFETs), or metal oxide semiconductor field-effect transistors (MOSFETs). By using the above circuit, it can achieve the goal of current balancing for multiple-CCFL.

For further understanding of the invention, reference is made to the following detailed description illustrating the embodiments and examples of the invention. The description is only for illustrating the invention and is not intended to be considered limiting the scope of the claim.

BRIEF DESCRIPTION OF THE DRAWINGS

The drawings included herein provide a further understanding of the invention. A brief introduction of the drawings is as follows:

FIG. 14 is a measured data of the driving current of the CCFLs, according to FIGS. 8, 9, 10, 11, 12 and 13.

DETAILED DESCRIPTION OF THE PREFERRED EMBODIMENTS

Figure 1:
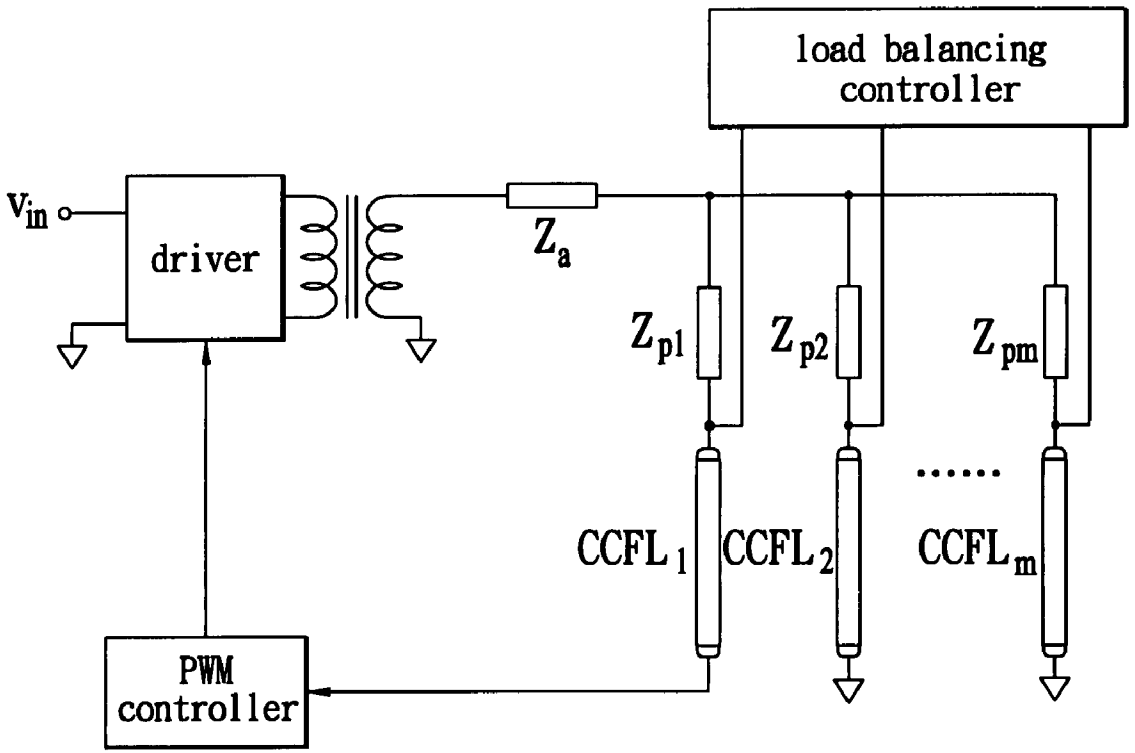
FIG. 1 PRIOR ART
FIG. 1 is a circuit diagram of the prior multiple-CCFL current balancing system comprised of impedance components.
Figure 2:
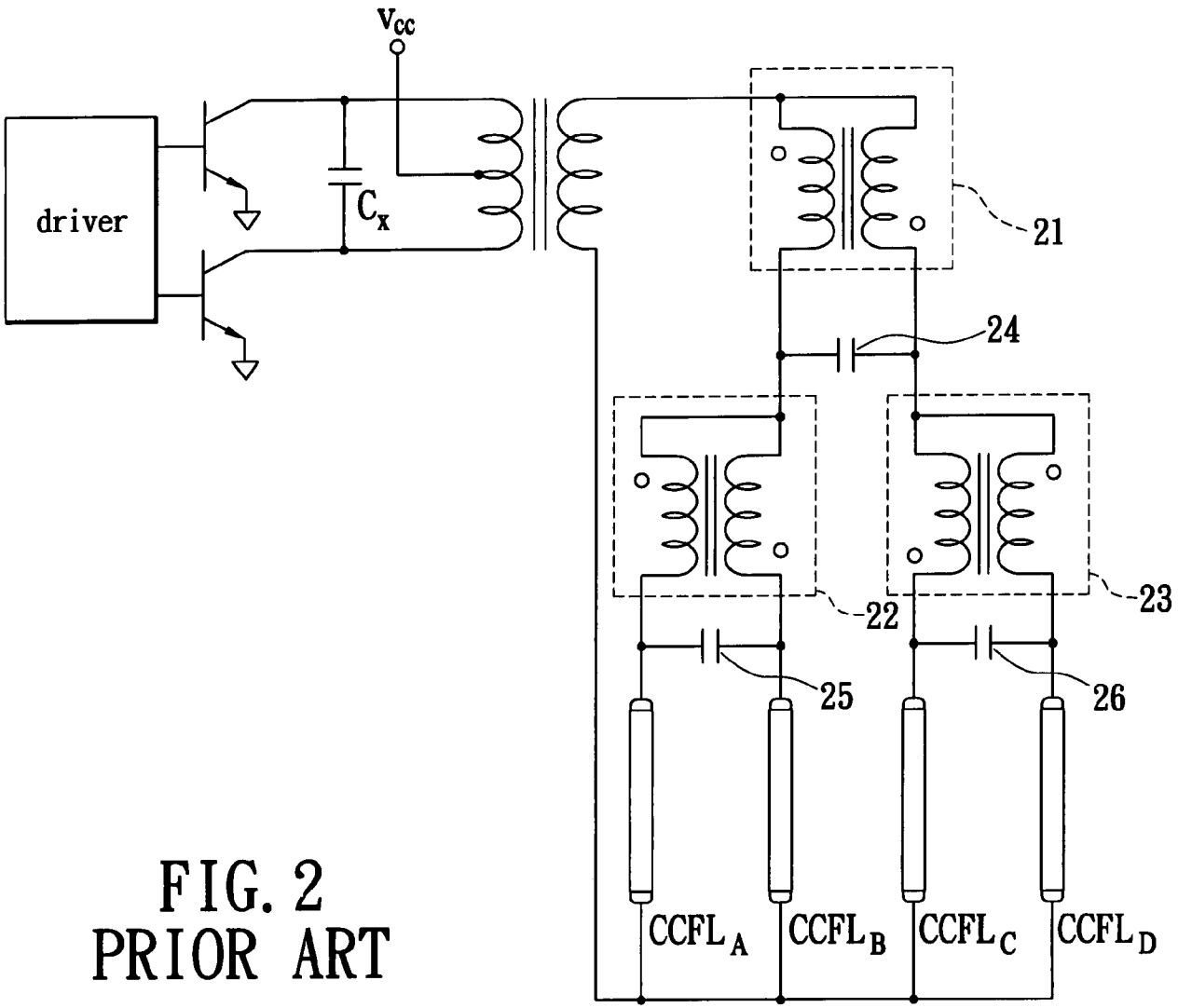
FIG. 2 PRIOR ART
FIG. 2 is a circuit diagram of the prior multiple CCFLs current balancing system with a differential current choke comprised of impedance components and transformers.
Figure 3:
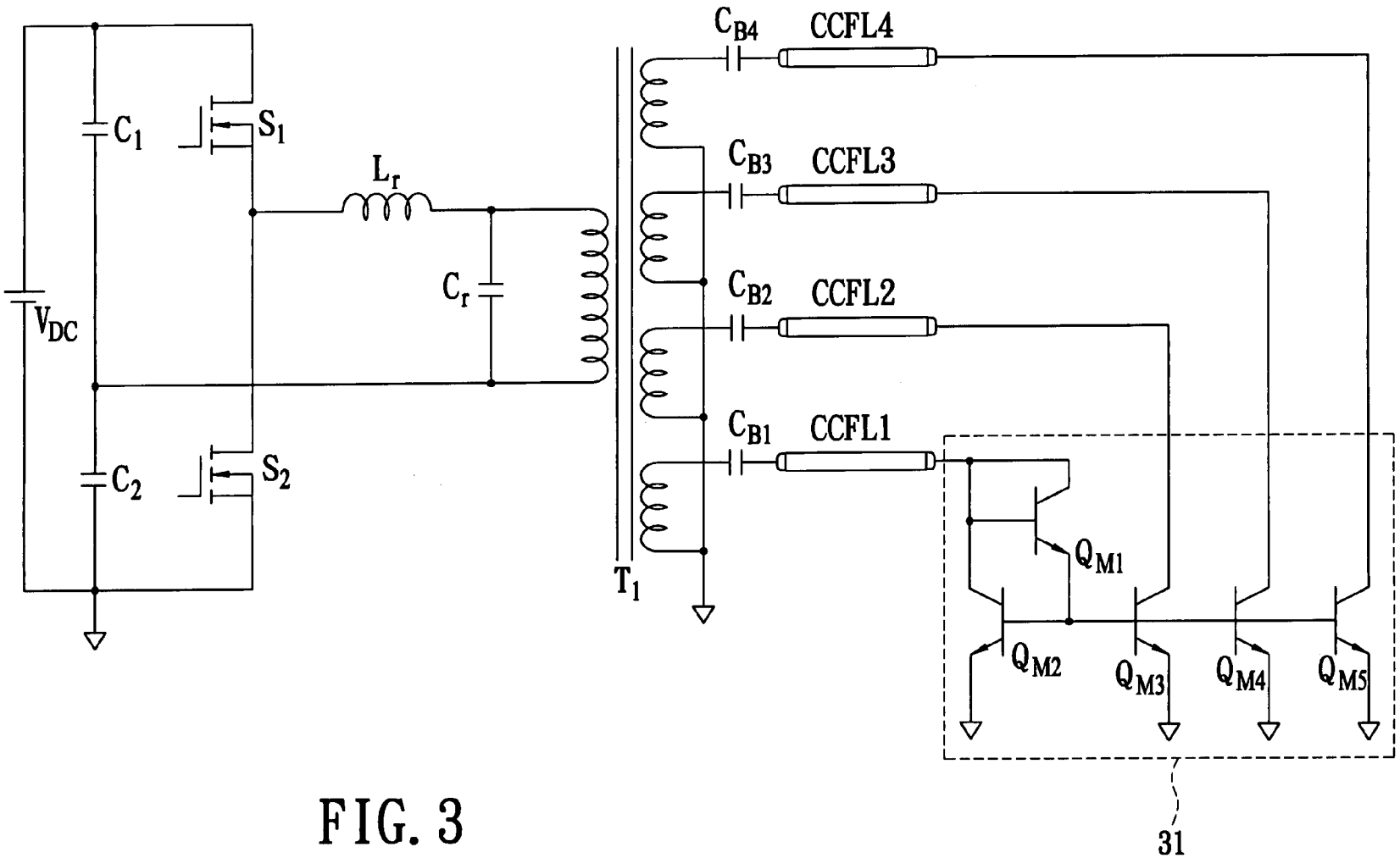
FIG. 3 is a circuit diagram of the present multiple CCFLs current balancing system.

Referring to FIG. 3, the present invention provides a multiple-CCFL parallel driving circuit comprising a half-bridge resonant inverter and a current balancing circuit 31. The half-bridge resonant inverter comprises a first switch $S_1$, a second switch $S_2$, a resonant inductor $L_r$, and a resonant capacitor $C_r$. After that, it uses a set of one to four boosting transformers $T_1$ to boost the sine-wave type voltage produced by the half-bridge resonant inverter. By this way, it can start up and drive the CCFLs, including CCFL1, CCFL2, CCFL3 and CCFL4. There are a plurality of ballast capacitors, $C_{B1}$, $C_{B2}$, $C_{B3}$ and $C_{B4}$, which are connected between the boosting transformer $T_1$ and CCFLs—CCFL1, CCFL2, CCFL3 and CCFL4. The turn numbers of four secondary sides of the boosting transformer $T_1$ are proportional to each other. It can drive the CCFLs by using the same voltage of the four secondary sides of the boosting transformer. Because the brightness of the CCFLs is proportional to the driving current, it can achieve the goal of equal brightness control by adjusting the driving current of the CCFLs.

The multiple CCFLs current balancing circuit 31 is comprised of BJTs. This circuit utilizes the characteristic of current mirror to balance the current of multiple CCFLs. The reference current of the current balancing circuit is the high frequency sine wave current used for driving CCFL1. In the steady state, the lamp is operating at 6 $mA_{rms}$, and can be treated as a resistance. It can equalize the driving current of the multiple CCFLs by using the driving current of CCFL1 as a reference current. By using the above method, it can control current balancing of the multiple-CCFLs—CCFL1, CCFL2, CCFL3 and CCFL4. Moreover, we can add a BJT $Q_{M1}$ into the multiple current balancing circuit 31 to reduce the effect of the β value of the BJTs to the multiple current balancing circuit 31. The multiple current balancing circuit 31 also can be comprised of JFETs or MOSFETs. It can maintain the difference of the driving current of the four CCFLs within ±5% (or ±0.3 $mA_{rms}$). Therefore, it can promote the display quality of a large-size LCD.

Figure 4:
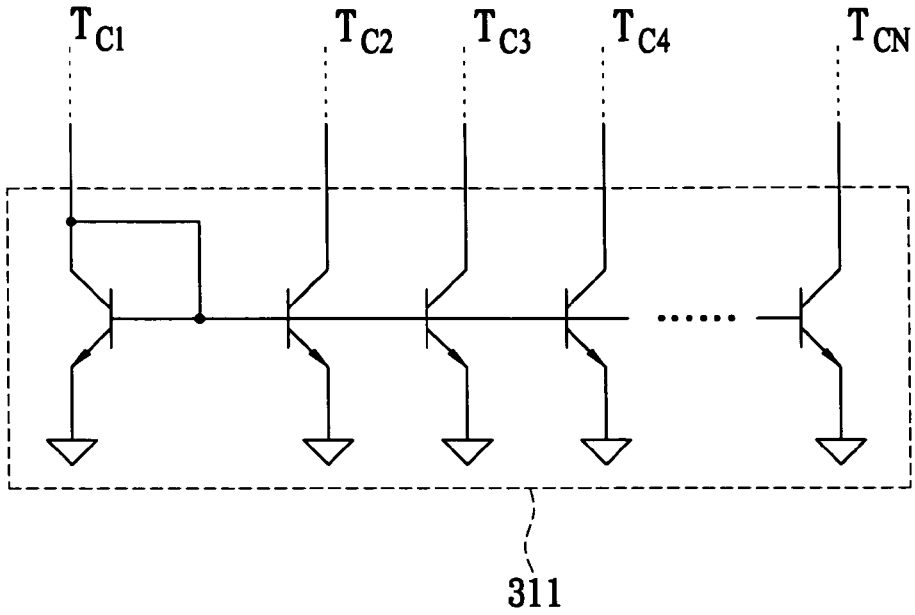
FIG. 4 is a circuit diagram of the first embodiment of the present multiple CCFLs current balancing circuit.

Referring to FIG. 4, a multiple-CCFLs current balancing circuit with a basic current mirror structure 311 is shown. This is the first embodiment of the multiple-CCFLs current balancing circuit. The connected points $T_{C1}$, $T_{C2}$, $T_{C3}$, and $T_{C4}$ to $T_{CN}$ are connected to a plurality of CCFLs. The multiple current balancing circuit with a basic current mirror structure 311 can be comprised of BJTs, JFETs or MOSFETs. It can achieve the result of the driving current balance of the multiple-CCFLs by the basic structure of the current mirror.

Figure 5:
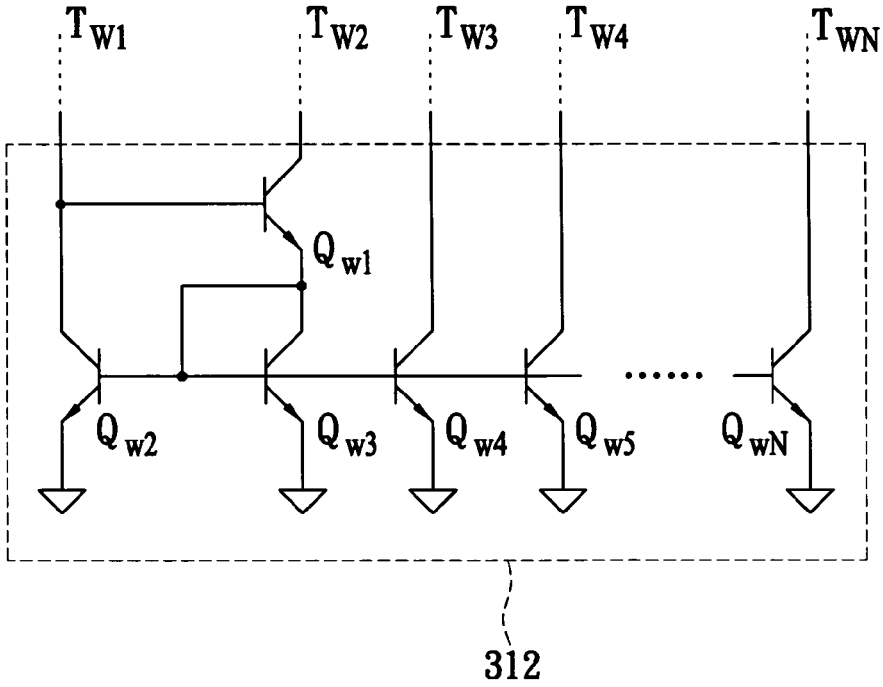
FIG. 5 is a circuit diagram of the second embodiment of the present multiple CCFLs current balancing circuit.

Referring to FIG. 5, a multiple CCFLs current balancing circuit with a current mirror structure for increasing output impedance of the current source 312 is shown. This is the second embodiment of the multiple-CCFL current balancing circuit. The connected points $T_{W1}$, $T_{W2}$, $T_{W3}$, and $T_{W4}$ to $T_{WN}$ are connected to a plurality of CCFLs. This circuit connects the collector and the base of the BJT $Q_{W3}$ together. It increases the output impedance of the current source by a negative feedback method. Therefore, it can reduce the influence of any change in the impedance of the CCFLs which affects the multiple CCFLs current balancing circuit. The multiple current balancing circuit with a basic current mirror structure 312 can be comprised of BJTs, JFETs or MOSFETs.

Figure 6:
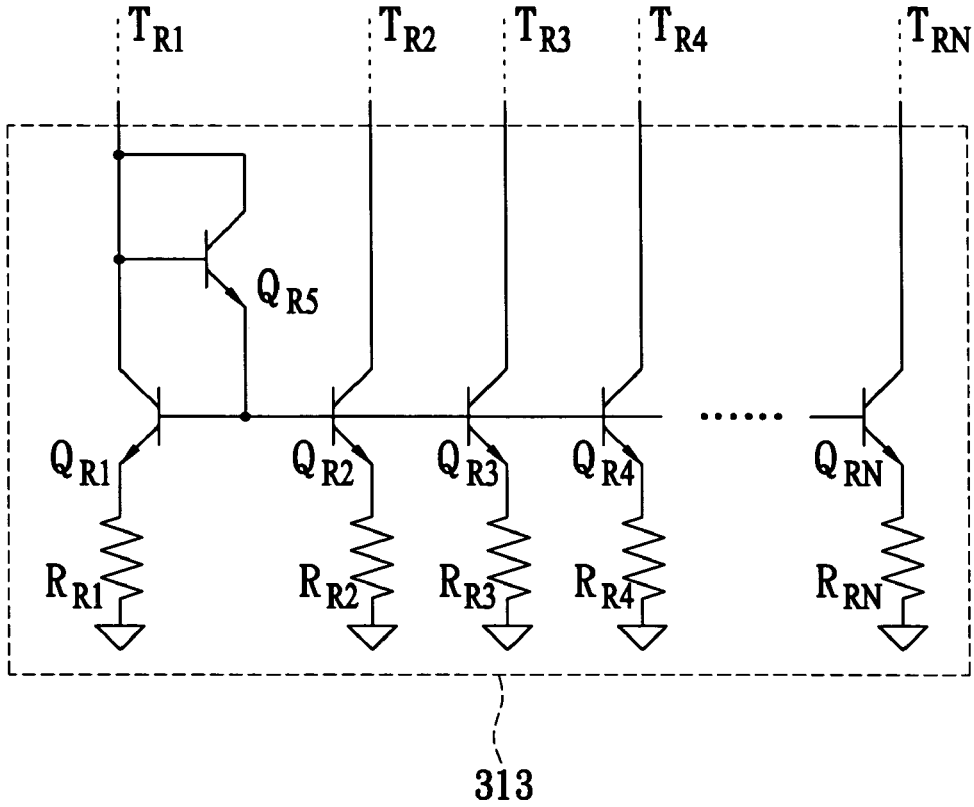
FIG. 6 is a circuit diagram of the third embodiment of the present multiple CCFLs current balancing circuit.

Referring to FIG. 6, a multiple CCFLs current balancing circuit with a current mirror structure and proportional resistances 313 is shown. This is the third embodiment of the multiple-CCFL current balancing circuit. The connected points $T_{R1}$, $T_{R2}$, $T_{R3}$, and $T_{R4}$ to $T_{RN}$ are connected to a plurality of CCFLs. The emitters of a plurality of BJT $Q_{R1}$, $Q_{R2}$, $Q_{R3}$, and $Q_{R4}$ to $Q_{RN}$ are each connected to proportional resistances $R_{R1}$, $R_{R2}$, $R_{R3}$, and $R_{R4}$ to $R_{RN}$. The multiple-CCFLs current balancing circuit can fine-tune the driving current of the CCFLs by adjusting the impedance values of the proportional resistances $R_{R1}$, $R_{R2}$, $R_{R3}$, and $R_{R4}$ to $R_{RN}$. It can precisely adjust the driving currents of the multiple-CCFLs by altering the impedance values of the proportional resistances, thereby balancing the current. The multiple current balancing circuit with a current mirror structure and proportional resistances 313 can be comprised of BJTs, JFETs or MOSFETs.

Figure 7:
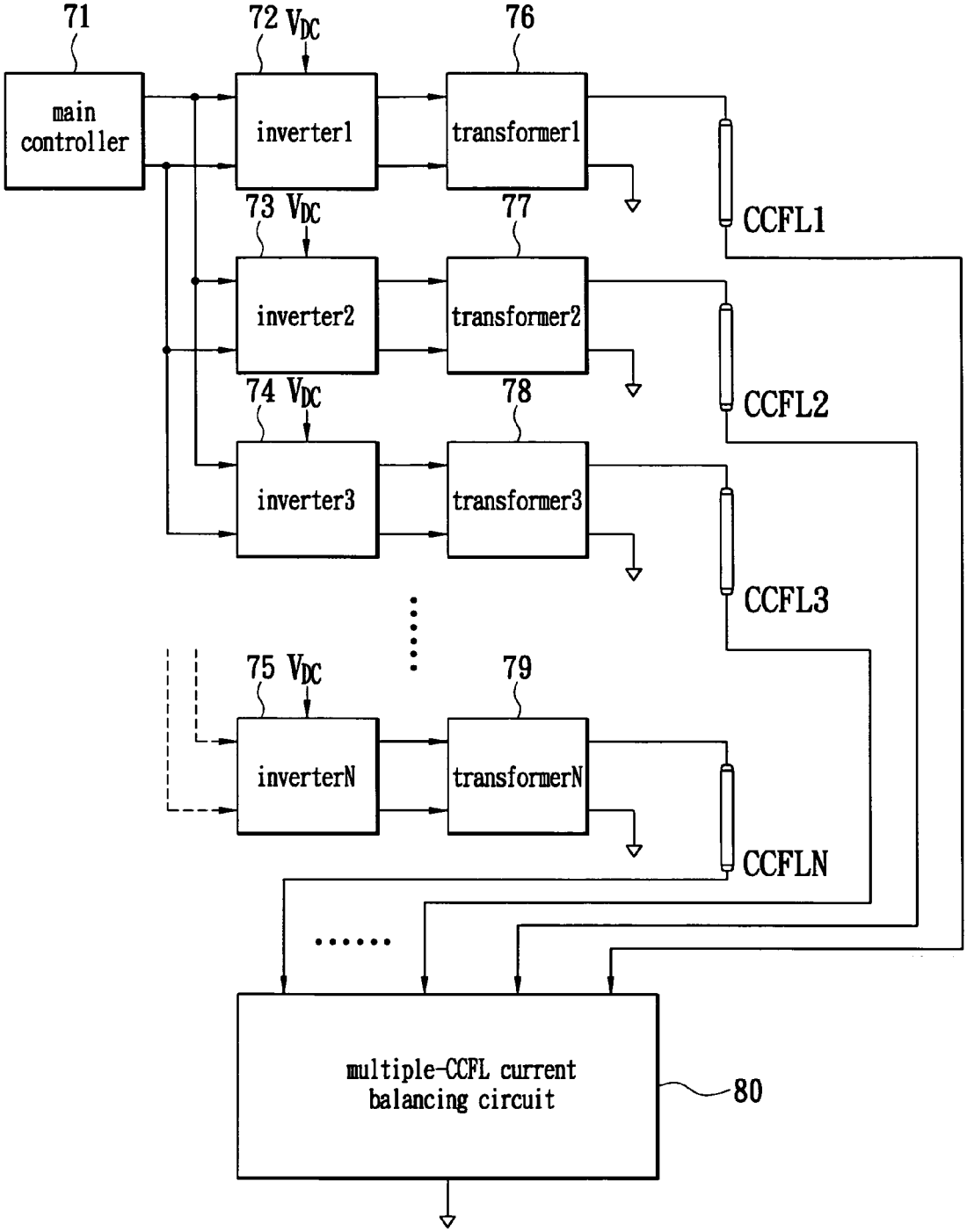
FIG. 7 is a system diagram of the preferred embodiment of the system for driving the CCFLs.

Referring to FIG. 7, a system diagram of the backlight system for driving the CCFLs is shown. The system comprises a plurality of CCFLs—CCFL1, CCFL2, CCFL3 and CCFLN, one set of main controller 71, a plurality of inverters 72, 73, 74 and 75, a plurality of transformers 76, 77, 78, 79, and a multiple CCFLs current balancing circuit 80. The CCFLs provide the backlight for the LCD. The main controller 71 produces a high frequency switching pulse as a control signal to the inverters 72, 73, 74 and 75. The inverters 72, 73, 74 and 75, convert the dc power to high frequency pulse power by using the switching method. The high frequency pulse power can be transferred to a high frequency sine wave voltage by using a resonant circuit. The transformers 76, 77, 78 and 79 boost the high frequency sine wave voltage to drive the CCFLs—CCFL1, CCFL2, CCFL3 and CCFLN. The multiple-CCFL current balancing circuit 80 equalizes the driving current of the CCFLs and achieves balance status. The main controller 71 comprising a pulse width modulation (PWM) control circuit adjusts the frequency and duty cycle of output pulse. The plurality of inverters could comprise of a half bridge resonant circuit, a full bridge resonant circuit or a class-E resonant circuit. The inverters convert the inputted dc power into high frequency pulse power and transform it to high frequency sine wave power. The transformers could be winding transformers or piezoelectric transformers to drive the CCFLs and make the LCD monitor thinner. The multiple current balancing circuits of the CCFLs can be of any of the types used in FIG. 3 to FIG. 6.

Figure 8:
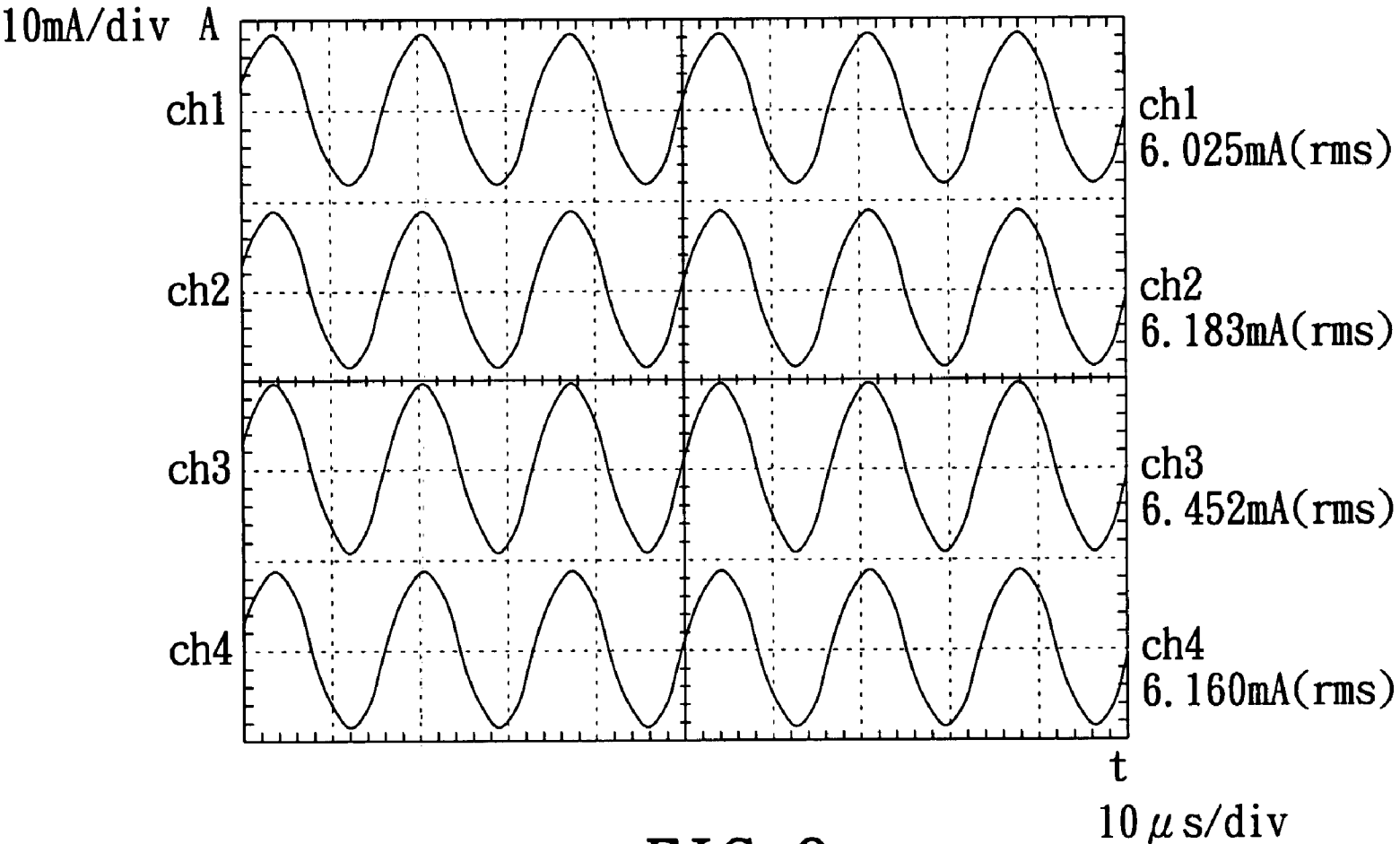
FIG. 8 is a measured waveform diagram of the driving current of CCFLs without multiple CCFLs current balancing circuit, operating at 6 $mA_{rms}$.
Figure 9:
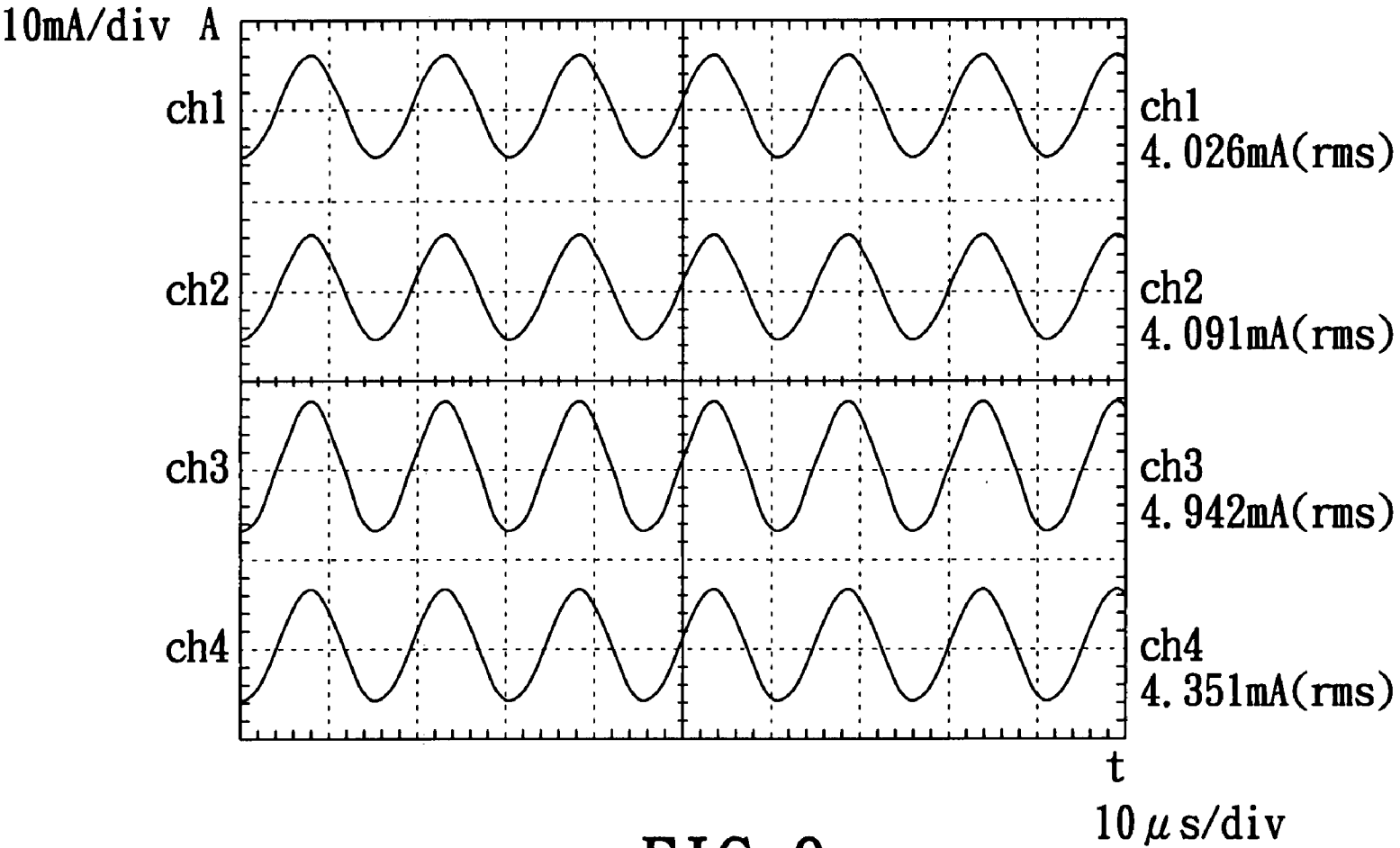
FIG. 9 is a measured waveform diagram of the driving current of CCFLs without multiple CCFLs current balancing circuit, operating at 4 $mA_{rms}$.
Figure 10:
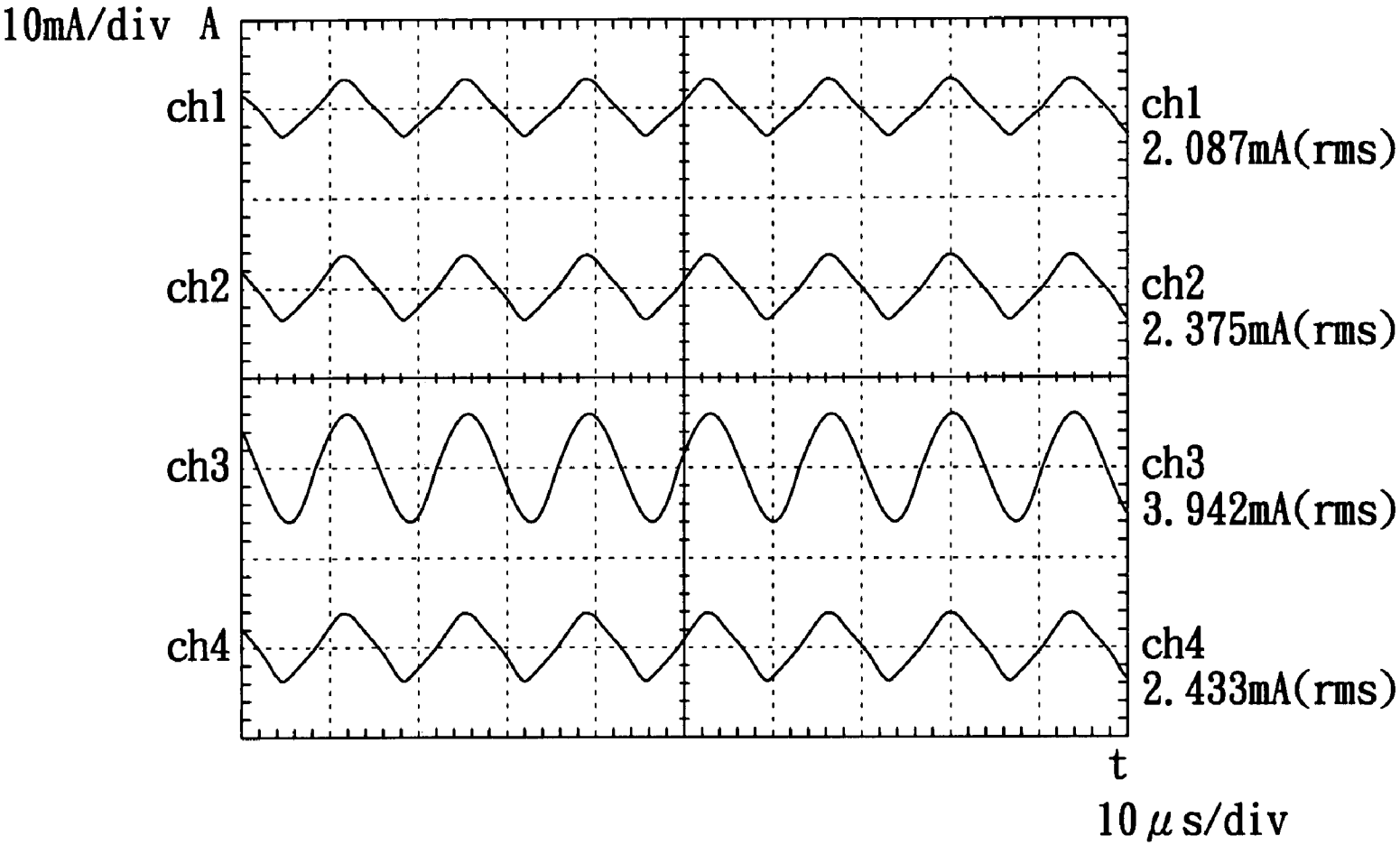
FIG. 10 is a measured waveform diagram of the driving current of CCFLs without multiple CCFLs current balancing circuit, operating at 2 $mA_{rms}$.

From FIG. 8 to FIG. 10, measured waveform diagrams of the driving current of CCFLs without a multiple-CCFL current balancing circuit are shown. The horizontal axis is time, the unit is 10 μs/div., the vertical axis is current, and the unit is 10 mA/div., ch1 is the measured driving current waveform of CCFL1, ch2 is the measured driving current waveform of CCFL2, ch3 is the measured driving current waveform of CCFL3 and ch4 is the measured driving current waveform of CCFL4. FIG. 8 shows the measured condition of CCFLs of ch1 when operated at 6.025 $mA_{rms}$. The difference of driving current is 0.158 $mA_{rms}$ between ch2 and ch1. The difference of driving current is 0.427 $mA_{rms}$ between ch3 and ch1. The difference of driving current is 0.135 $mA_{rms}$ between ch4 and ch1. FIG. 9 shows the measured condition of CCFLs of ch1 when operated at 4.026 $mA_{rms}$. The difference of driving current is 0.0658 $mA_{rms}$ between ch2 and ch1. The difference of driving current is 0.915 $mA_{rms}$ between ch3 and ch1. The difference of driving current is 0.325 $mA_{rms}$ between ch4 and ch1. FIG. 10 shows the measured condition of CCFLs of ch1 when operated at 2.087 $mA_{rms}$. The difference of driving current is 0.288 $mA_{rms}$ between ch2 and ch1. The difference of driving current is 1.855 $mA_{rms}$ between ch3 and ch1. The difference of driving current is 0.346 $mA_{rms}$ between ch4 and ch1. The measured waveform diagrams of FIGS. 8, 9 and 10, show the difference of the driving current between the four sets of CCFLs, are all over the tolerance level ±5% (or ±0.3 $mA_{rms}$). Therefore, the driving circuit without multiple CCFLs current balancing circuit will affect the uniformity of the image of the LCD.

Figure 11:
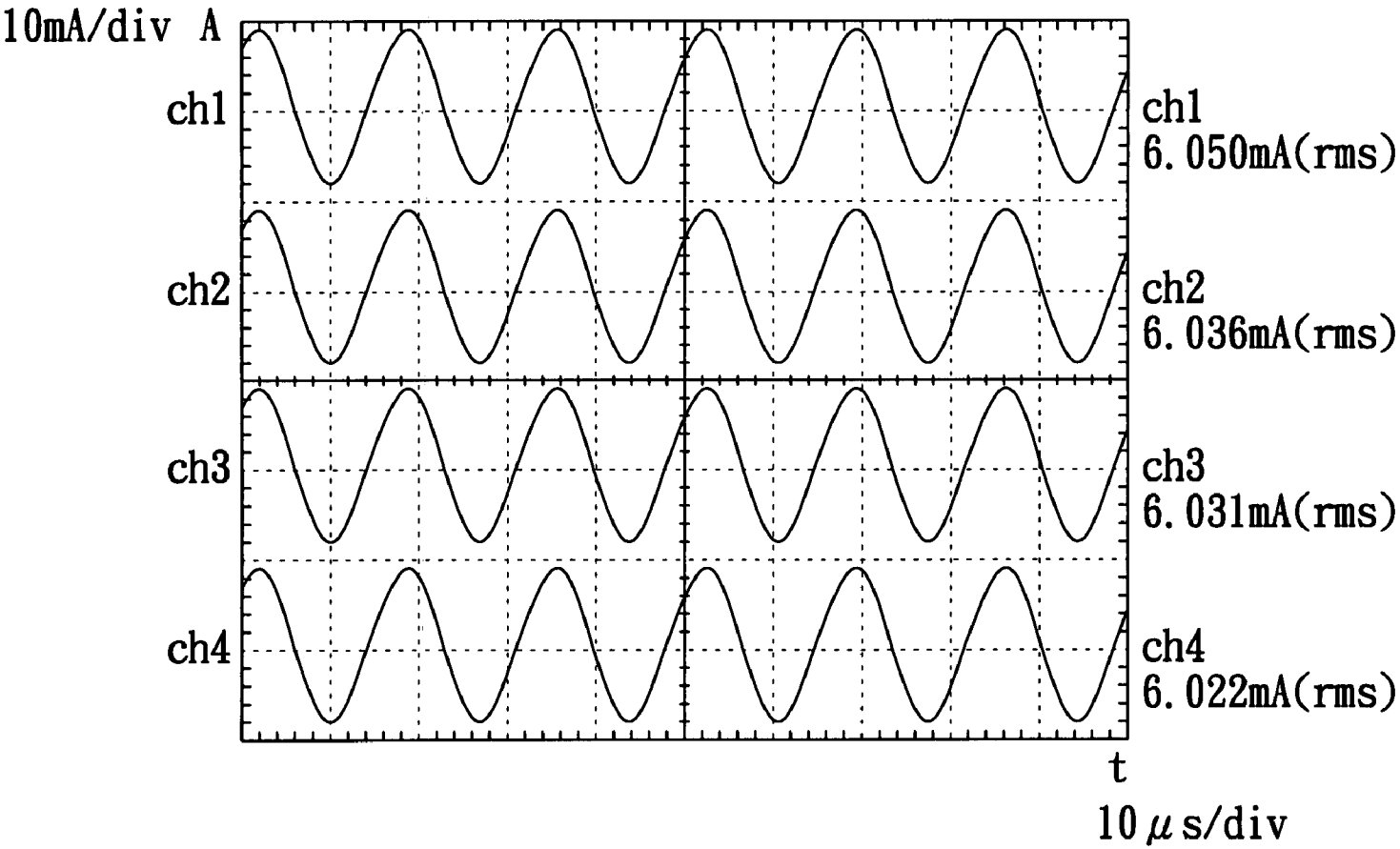
FIG. 11 is a measured waveform diagram of the driving current of CCFLs with the present multiple CCFLs current balancing circuit, operating at 6 $mA_{rms}$.
Figure 12:
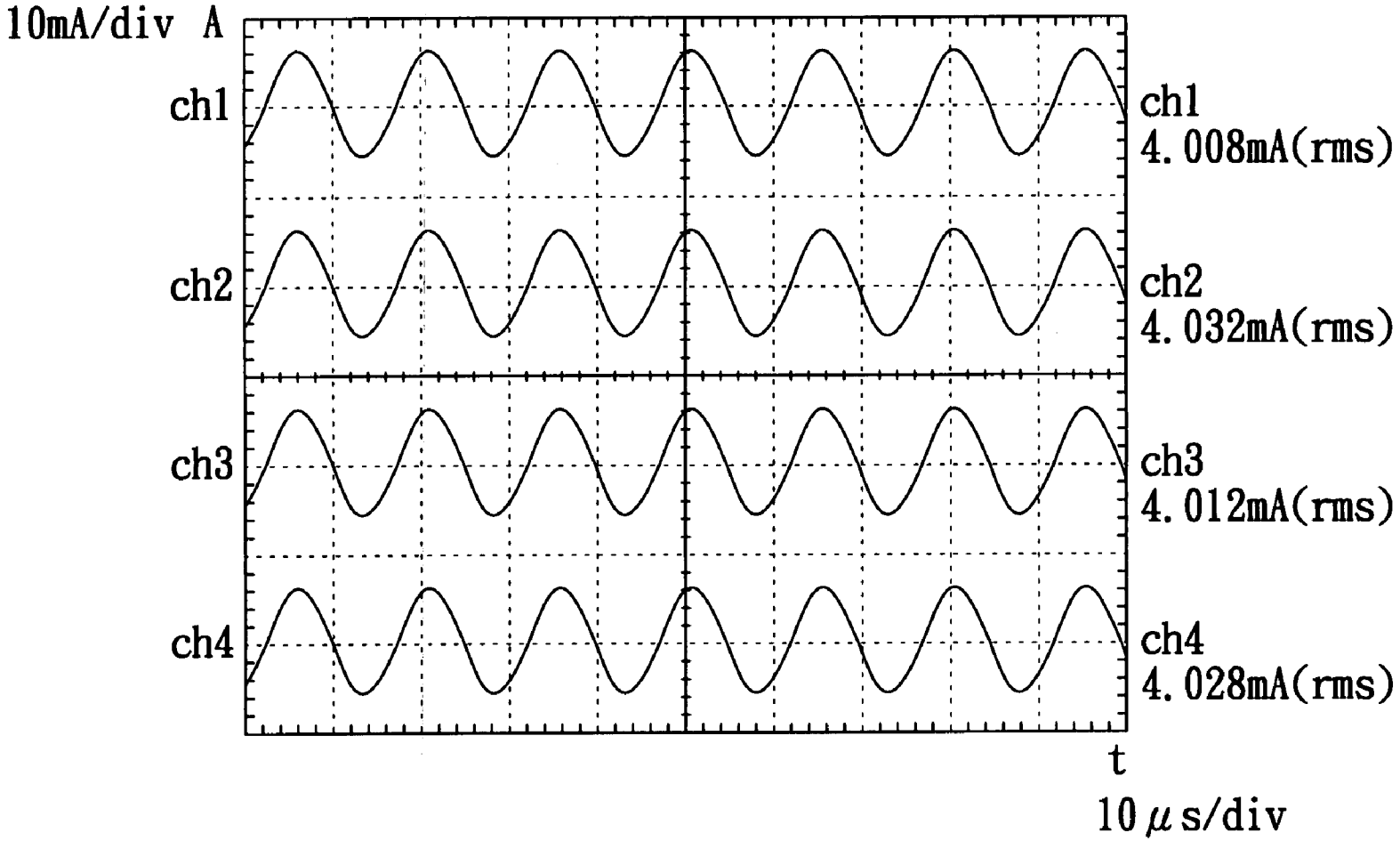
FIG. 12 is a measured waveform diagram of the driving current of CCFLs with the present multiple CCFLs current balancing circuit, operating at 4 $mA_{rms}$.
Figure 13:
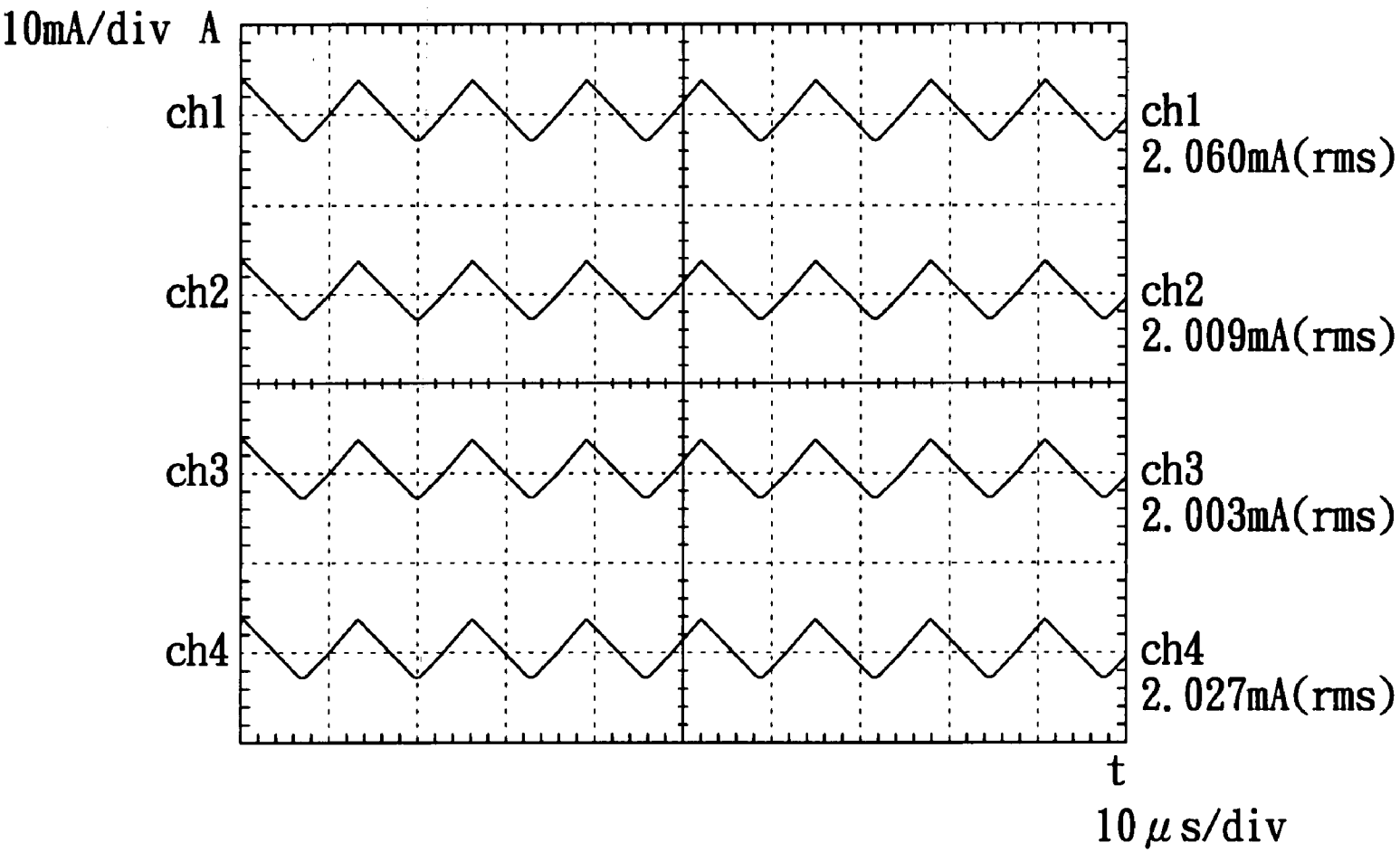
FIG. 13 is a measured waveform diagram of the driving current of CCFLs with the present multiple CCFLs current balancing circuit, operating at 2 $mA_{rms}$.

From FIG. 11 to FIG. 13, the measured waveform diagrams of the driving current of CCFLs with a multiple CCFL current balancing circuit 31 are shown. The horizontal axis is time, the unit is 10 μs/div., the vertical axis is current, and the unit is 10 mA/div. When the CCFLs of ch1 operate under the conditions of 6.050 $mA_{rms}$, 4.008 $mA_{rms}$ and 2.060 $mA_{rms}$, the difference of driving current between ch1, ch2, ch3 and ch4 is far below the tolerance level ±5% (or ±0.3 $mA_{rms}$). Therefore, it can balance the brightness of the CCFLs by equalizing the driving current of the CCFLs and then improve the display quality of the LCD.

FIG. 14 shows the measured data of the driving current of the four sets of CCFLs from FIG. 8 to FIG. 13. In this figure, the conclusion is reached that the difference in the driving current without a multiple-CCFL current balancing circuit is much worse than the difference in the driving current with a multiple-CCFL current balancing circuit. Therefore, the multiple-CCFL current balancing circuit can really equalize the driving current of multiple-CCFLs.

Figure 15:
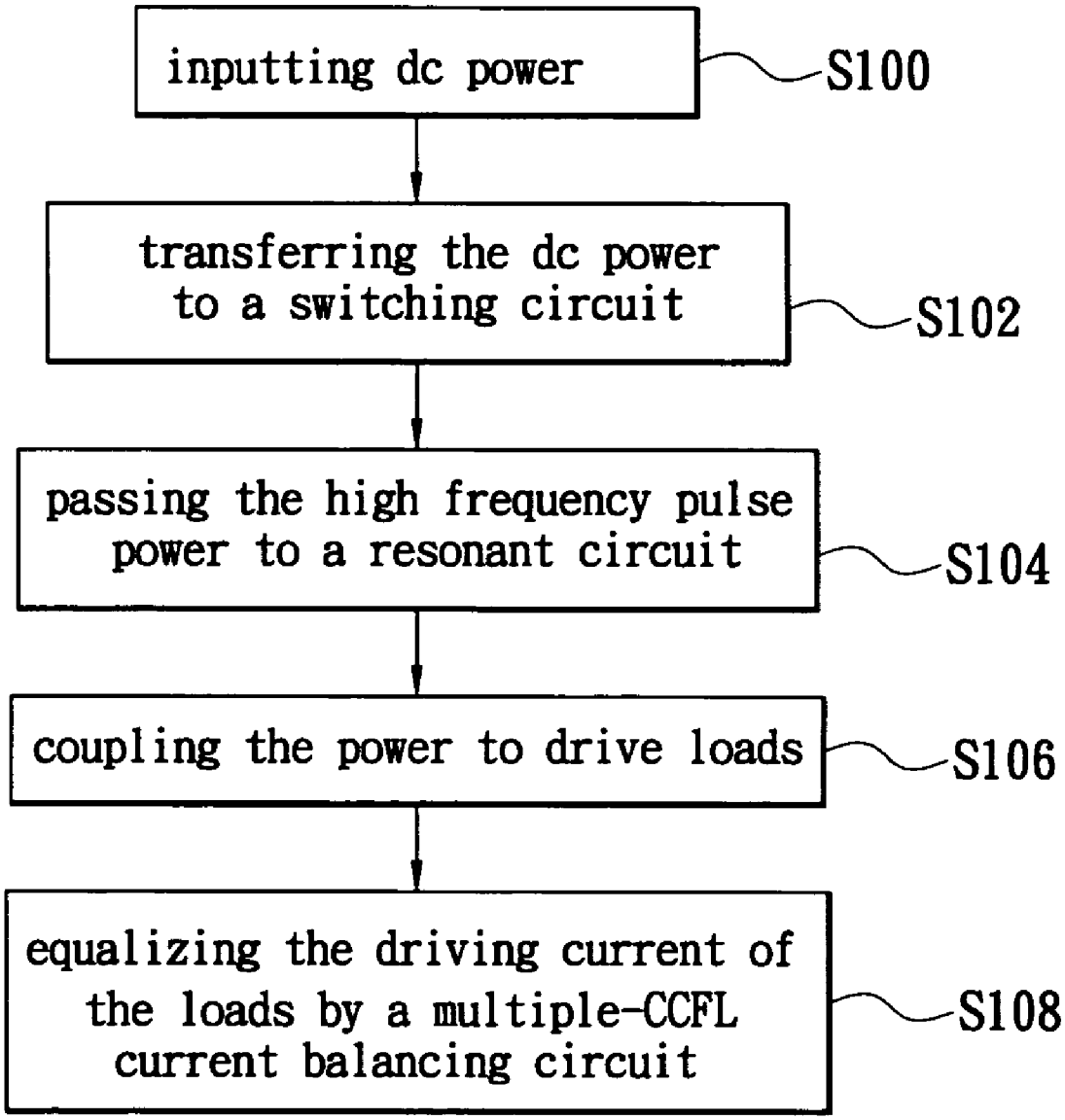
FIG. 15 is a flow chart of the present current balancing control method.

Referring to FIG. 15, the present invention provides a current balancing control method for a multiple-CCFLs parallel driving circuit for a LCD. It comprises the following steps:

Inputting dc power S100, the dc power provides a dc voltage to the switching circuit.

Transferring the dc power to a switching circuit S102, the switching circuit controls the switching on and off through a timing signal. By this way, the switch circuit can convert the dc power to high frequency pulse power and pass it to a resonant circuit.

Having passed the high frequency pulse power to a resonant circuit S104, the resonant circuit transfers the high frequency pulse power to a sine wave voltage and then boosts the sine wave voltage through a boosting transformer in order to drive the CCFLs.

Coupling the power to the load S106, it couples and boosts the sine wave power outputted from the resonant circuit and drives the load.

Equalizing the driving current of the loads by a multiple-CCFL current balancing circuit S108.

The characteristics and functions of the present invention are listed as following:

1. It can equalize precisely the driving current of multiple CCFLs by using a multiple-CCFL current balancing circuit with the structure of current mirror. The structure of current mirror can be comprised of BJTs, JFET or MOSFETs. It is both cheap and easy to make the circuit into an IC. Therefore, the multiple-CCFL current balancing circuit can reduce the area and volume of the circuit. At the same time, it substantially reduces the adverse effects of increased temperature experienced due to enclosing the impedance components and magnetic components in the apparatus.

2. It can equalize the driving current of multiple CCFLs by using a multiple-CCFL current balancing circuit. Therefore, we can select a proper dimming method of gas discharging tube, depending on requirements, to adjust the brightness of CCFLs. The dimming method includes duty-cycle control, frequency control and burst dimming control. It is easy to adjust the brightness of CCFLs without modifying the original feedback compensated circuit. Furthermore, it increases the stability and performance of the whole system.

3. The present invention uses the half bridge resonant inverter as a structure of the main circuit. This circuit uses a set of boosting transformers of one-input-four-output to drive the CCFLs. Finally, this invention uses a current mirror structure to balance the driving current of multiple-CCFLs. Therefore, this circuit reduces the volume and cost of a plurality of transformers.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A multiple-CCFL parallel driving circuit for a LCD, comprising:

a plurality of sets of CCFLs, providing a backlight for a LCD;

a boosting transformer with a plurality of sets of outputs, providing a driving voltage and current for driving the plurality of sets of CCFLs;

a plurality of ballast capacitors, the ballast capacitors are connected between the boosting transformer and the CCFLs; and a multiple-CCFL current balancing circuit, the multiple-CCFL current balancing circuit is a current mirror circuit comprised of a plurality of bipolar junction transistors and equalizes driving current of the plurality of sets of CCFLs, the reference of the current mirror circuit is connected to output of the first CCFL of the plurality sets of CCFLs in order to equalize the driving current of the second CCFL, the third CCFL and the fourth CCFL.

2. The multiple-CCFL parallel driving circuit for a LCD of claim 1, wherein the multiple-CCFL current balancing circuit comprises of a basic current mirror circuit and an additional bipolar junction transistor, to reduce the effect of β value of the transistor to the multiple-CCFL parallel driving circuit.

3. The multiple-CCFL parallel driving circuit for a LCD of claim 1, wherein the multiple-CCFL current balancing circuit comprises of a basic current mirror circuit and an additional bipolar junction transistor, connects a collector and a base of the transistor together, to increase the output impedance of a current source of the current mirror circuit by using a negative feedback method.

4. The multiple-CCFL parallel driving circuit for a LCD of claim 1, wherein the multiple-CCFL current balancing circuit comprises of a basic current mirror circuit and connects separately a proportional resistance onto the emitter of each bipolar junction transistor, thereby reducing a difference value of a driving current by adjusting an impedance value of the proportional resistance and fine-tuning the driving current of the CCFLs.

5. The multiple-CCFL parallel driving circuit for a LCD of claim 1, wherein the multiple-CCFL current balancing circuit comprises of junction field-effect transistors.

6. The multiple-CCFL parallel driving circuit for a LCD of claim 1, wherein the multiple-CCFL current balancing circuit comprises of metal oxide semiconductor field-effect transistors.

7. The multiple-CCFL parallel driving circuit for a LCD of claim 1, wherein the boosting transformer comprises of a winding transformer with one-input-four-outputs, and a sinusoidal voltage outputted from a resonant circuit is sent to the primary side of the boosting transformer and then drives the CCFLs.

8. The multiple-CCFL parallel driving circuit for a LCD of claim 1, wherein numbers of turns of four sets of secondary sides of the boosting transformer have the same proportion, to drive the CCFLs by the same voltage on the secondary sides.

9. A multiple-CCFL parallel driving circuit for a LCD, comprising:

a plurality of sets of CCFLs, providing a backlight for a LCD;

a main controller, providing a high frequency switching pulse;

a plurality of inverters, converting an inputted dc power into a plurality of high frequency sine waves;

a plurality of transformers, boosting the high frequency sine waves outputted from inverters to drive the CCFLs; and a multiple-CCFL current balancing circuit, the multiple-CCFL current balancing circuit is a current mirror circuit comprised of a plurality of bipolar junction transistors and equalizes driving current of the plurality sets of CCFLs, the reference of the current mirror circuit is connected to an output of the first CCFL of the plurality of sets of CCFLs in order to equalize the driving current of the second CCFL, the third CCFL and the fourth CCFL.

10. The multiple-CCFL parallel driving circuit for a LCD of claim 9, wherein the main controller comprises of a pulse width modulation control circuit, to adjust the frequency and duty cycle of the outputted pulse.

11. The multiple-CCFL parallel driving circuit for a LCD of claim 9, wherein the multiple-CCFL current balancing circuit comprises metal oxide semiconductor field-effect transistors.

12. The multiple-CCFL parallel driving circuit for a LCD of claim 9, wherein the plurality of transformers can be winding transformers or piezoelectric transformers, to boost the voltage of the high frequency sine to waves.

13. The multiple-CCFL parallel driving circuit for a LCD of claim 9, wherein the multiple-CCFL current balancing circuit comprises of a basic current mirror circuit and an additional bipolar junction transistor, reducing the adverse effects caused by the β value of transistor to current balancing of the multiple-CCFL parallel driving circuit.

14. The multiple-CCFL parallel driving circuit for a LCD of claim 9, wherein the multiple-CCFL current balancing circuit comprises of a basic current mirror circuit and an additional bipolar junction transistor, connects a collector and a base of the transistor together, to increase the output impedance of the current source of the current mirror circuit by using a negative feedback method.

15. The multiple-CCFL parallel driving circuit for a LCD of claim 9, wherein the multiple-CCFL current balancing circuit comprises a basic current mirror circuit and connects separately to a proportional resistance on the emitter of each bipolar junction transistor, to reduce difference values between those driving currents by adjusting an impedance value of the proportional resistance and fine-tuning the driving current of the CCFLs.

16. The multiple-CCFL parallel driving circuit for a LCD of claim 9, wherein the multiple-CCFL current balancing circuit comprises junction field-effect transistors.

17. A current balancing control method for a multiple-CCFL parallel driving circuit of LCD, comprises steps of:

inputting dc power, the dc power provides a dc voltage to a switching circuit;

transferring the dc power to a switching circuit, the switching circuit is turned on and off by a timing signal, so as to convert the dc power to high frequency pulse power;

passing the high frequency pulse power to a resonant circuit, the resonant circuit transfers the high frequency pulse power produced by the switching circuit to a sine wave voltage;

coupling the power to drive loads through a boosting transformer, the boosting transformer couples and boosts the sine wave power outputted from the resonant circuit to drive the loads; and equalizing the driving current of the loads by a multiple CCFL current balancing circuit.

* * * * *